US005095242A

United States Patent [19]

Richeson

[11] Patent Number: 5,095,242

[45] Date of Patent: Mar. 10, 1992

[54] LOW RADIO INTERFERENCE SPARK PLUG

[75] Inventor: William E. Richeson, Fort Wayne, Ind.

[73] Assignee: North American Philips Corporation, New York, N.Y.

[21] Appl. No.: 557,367

[22] Filed: Jul. 24, 1990

[51] Int. Cl.[5] ..... H01T 13/20

[52] U.S. Cl. ..... 313/143; 313/136; 313/137; 315/58

[58] Field of Search ..... 313/136, 137, 143; 315/58

[56] References Cited

U.S. PATENT DOCUMENTS 4,460,847 7/1984 Englehardt ..... 313/136

4,795,944 1/1989 Stinson ..... 315/58

*Primary Examiner*—Donald J. Yusko

*Assistant Examiner*—Diab Hamadi

*Attorney, Agent, or Firm*—Robert J. Kraus

[57] ABSTRACT

In a preferred embodiment, a resistor spark plug having a low level of RFI emissions, achieved by means of reducing the capacitances within the spark plug, so that the resistor in the spark plug is more effective. Reduction of the capacitances is accomplished by providing a resistor of relatively narrow diameter, providing a clearance space between the shell of the spark plug and the portion of the insulator where the resistor is located, and by providing an extended shell around the insulator above where the resistor is located. The improved effectiveness of the resistor reduces the energy transferred across the spark gap and, therefore, reduces erosion of the electrodes.

7 Claims, 3 Drawing Sheets

LOW RADIO INTERFERENCE SPARK PLUG

BACKGROUND OF THE INVENTION

1. Field of the Invention

The present invention relates generally to spark plugs for internal combustion engines and, more particularly, to a novel spark plug for such engines which emits a low level of radio frequency electromagnetic radiation.

2. Background Art

Spark plugs are well known devices for creating a source of ignition for the combustion of fuel in internal combustion engines and may be, for example, of the construction described in U.S. Pat. No. 4,796,944, Issued Jan. 8, 1989, to Stimson. Conventional such spark plugs produce a relatively high level of radio frequency interference (RFI). In the past, such RFI was primarily of concern to the extent that it caused interference with radio broadcasts received in the vehicles in which the internal combustion engines were installed and also in nearby vehicles. Recently, however, with the advent of computer controlled ignition, carburetion, valve timing, and other functions, there is concern that RFI may cause problems with the computers controlling such functions.

The source of internal combustion engine ignition RFI is primarily due to the spark breakdown that takes place at the spark plug gaps before arcing begins. The RFI is generated by the large di/dt caused by discharging a capacitor (that has been charged to a high voltage) through a low impedance circuit. The capacitance is primarily in the structure of the spark plug itself and can range equivalently from 8.5–12 pf. The breakdown voltage is highly variable depending upon engine torque and ranges ordinarily from 8–24 KV. The initial spark breakdown current can range from 0.5–3.0 KA and the duration is on the order of $10^{-10}$ seconds. The stored energy that is discharged is $\frac{1}{2}CE^2 \cong 1$ mj and the $di/dt \cong 10^7$ A/microsecond. This breakdown is followed by an arc discharge that typically is at 800 volts, 40 mA, may last 1.5 milliseconds, and may typically have 40–50 mj of energy and creates comparatively little RFI. Though the energy dissipated during arcing is 40 times that of the initial discharge, its rate of delivery is in the order of $10^{12}$ times slower. During the arcing phase, the metal conducts the heat away from its surface and the rate of surface sublimation is, therefore, less than during the breakdown phase. The RFI spectrum power associated with the spark breakdown is large, is conducted away to the outside world through the spark plug, and is principally radiated by the external high tension circuit.

Several major industry moves have reduced the radiated RFI. The first was to incorporate a series resister in the high tension circuitry which was followed by incorporating a resistor in the spark plug itself. Resistive high tension wire was also used. Inductors incorporated in the spark plug or the high tension wiring were also used with less than satisfactory overall economic results. All of these moves did reduce RFI to a greater or lesser extent. The continuing concern has been about the degree of reduction, the cost, and the associated side issues such as concern with making the ignition system more sensitive to spark plug fouling and the fact that a good portion of the ignition energy was lost in the resistors. Due to the latter factor, the ignition system power had to be increased by a factor of approximately two.

The resistive techniques gained the broadest application: however, they require both the resistor spark plug and the resistor wire to meet government and industry requirements and further future reduction of the RFI using these techniques as now applied would appear marginal. Increasing the circuit resistance still further increases the power that the ignition system requires in overcoming the associated losses. If the resistance of the spark plug is 5 KΩ and the high tension circuit is 10 KΩ and 40 mj is desired in the ignition spark gap, there would be approximately $I^2Rt = (0.04)^2(20 \times 10^3)(0.0015) = 48$ mj lost in the circuit. The ignition system must produce approximately 88 mj to deliver 40 mj in the spark gap. In addition to this, as the total circuit resistance increases, the ignition system becomes increasingly sensitive to spark plug fouling. The first reason that for this is that the fouling material can be carbon and/or moisture that can create a shunt resistive path which has two effects: (a) it drives down and delays the development of the ignition voltage at the spark gap, hence a higher voltage ignition system is required (hence higher energy) to overcome these effects and (b) more ignition system energy is required to overcome the losses incurred as the spark gap voltage is building to the point of breakdown. The second reason why more ignition energy is required is that if the spark gap is filled with fluid, a spark cannot take place until the fluid is vaporized by the electrical energy applied to it. This takes time and, therefore, if the circuit has a long length of resistance, the applied energy may be dissipated by external circuit resistance prior to the development of a spark.

In addition to the spark plug RFI and fouling problems, the spark plug electrode erosion rate is of great importance and is accelerated by the high rate of energy transfer during spark breakdown.

Accordingly, it is a principal object of the present invention to provide a spark plug which emits less radio frequency electromagnetic radiation.

A further object of the invention is to provide such a spark plug which can reduce the required energy of an ignition system.

An additional object of the invention is to provide such a spark plug which may be manufactured by conventional techniques.

Another object of the invention is to provide such a spark plug which can provide reduced fouling and erosion.

Other objects of the present invention, as well as particular features and advantages thereof, will be elucidated in, or be apparent from, the following description and the accompanying drawing figures.

SUMMARY OF THE INVENTION

The present invention achieves the above objects, among others, by providing, in a preferred embodiment, a resistor spark plug having a low level of RFI emissions, achieved by means of reducing the capacitances within the spark plug, so that the resistor in the spark plug is more effective. Reduction of the capacitances is accomplished by providing a resistor of relatively narrow diameter, providing a clearance space between the shell of the spark plug and the portion of the insulator where the resistor is located, and by providing an extended shell around the insulator above where the resistor is located. The improved effectiveness of the resistor reduces the energy transferred across the spark gap and, therefore, reduces erosion of the electrodes.

BRIEF DESCRIPTION OF THE DRAWING

Understanding of the present invention and the various aspects thereof will be facilitated by reference to the accompanying drawing figures, in which.

DETAILED DESCRIPTION OF THE PREFERRED EMBODIMENTS

Figure 1:
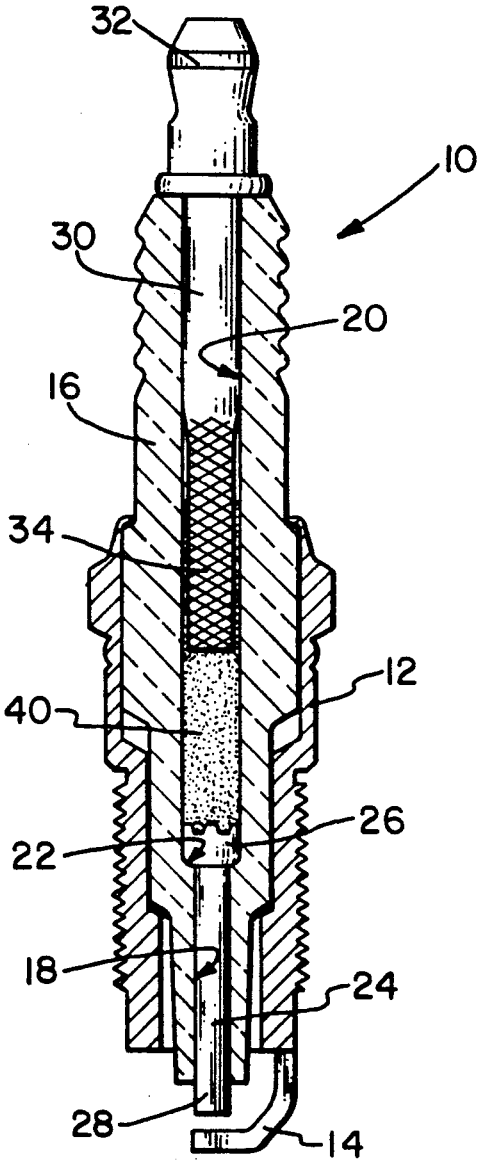
FIG. 1 PRIOR ART
FIG. 1 side elevational view, partially in cross-section, of a conventional resistance spark plug.

Referring now to the Drawing, FIG. 1 illustrates a conventional spark plug, generally indicated by the reference numeral 10.

Spark plug 10 includes an outer medal shell 12 having a ground electrode 14 welded to the lower end thereof. Positioned within shell 12 and secured thereto is a ceramic insulator 16. Insulator 16 is formed with a center bore having a lower portion 18 of relatively small diameter and an upper portion 20 of larger diameter, the upper and lower portions being joined at a ledge 22. Positioned in lower portion 18 is a center electrode 24 having an enlarged head 26 at the upper end thereof which rests on ledge 22 and having a lower end 28 which projects beyond the lower tip of insulator 16. Positioned in upper portion 20 is a terminal post 30 having an upper end 32 extending beyond insulator 16 for attachment thereto of a spark plug wire (not shown) and a lower, knurled end 34 the purpose of which will be described below.

During manufacture of spark plug 10, center electrode 24 is placed in insulator 16 in the position shown and then a particulate metal-and-glass-containing composition is placed in upper portion 20, partially filling it. Following this, terminal post 80 is placed in upper portion 20 of insulator 16 so that its lower end 34 rests on top of the particulate composition. The assembly is then fired in a furnace at a relatively high temperature to fuse the glass and soften the material so that lower end 34 can be pushed down into the material, thus capturing the lower end in the material. Upon hardening, the material forms a resistor element 40.

Figure 3:
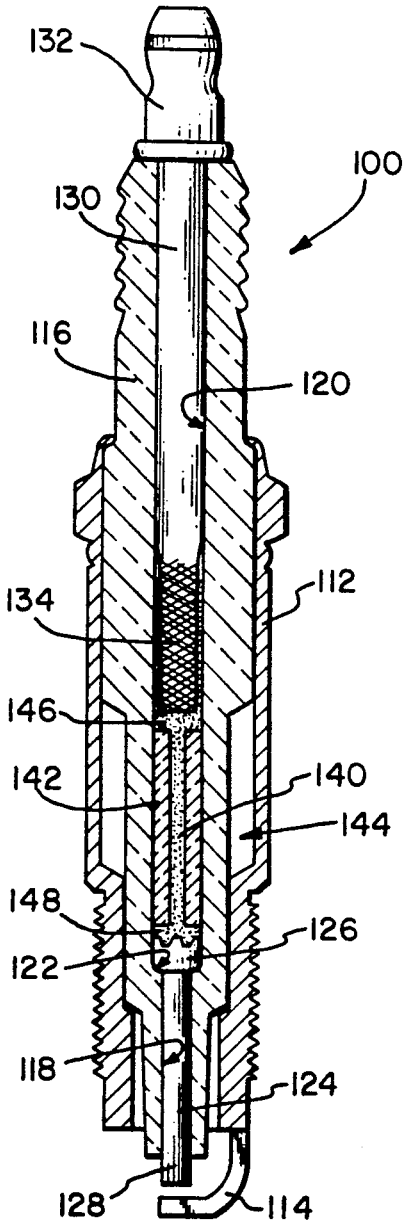
FIG. 3 is a side elevational view, partially in cross-section, of a spark plug constructed according to the present invention.
Figure 4:
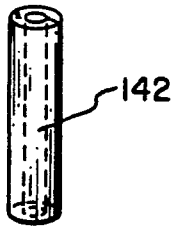
FIG. 4 is a top/side perspective view of an element of the spark plug of FIG. 3.
Figure 6:
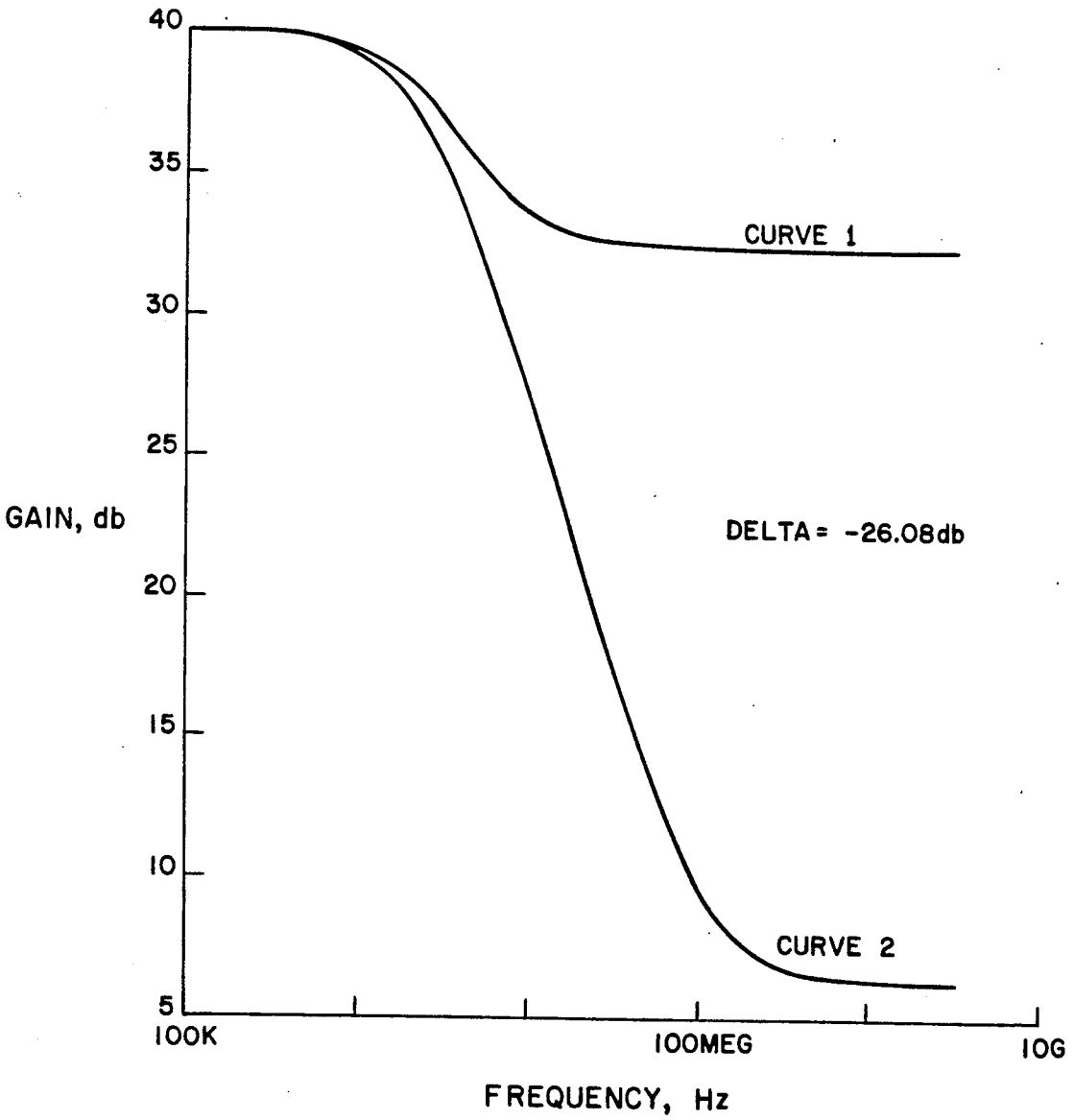
FIG. 6 is a computer-generated graph comparing the radio frequency emissions of the spark plugs of FIGS. 1 and 3.

FIG. 3 illustrates a spark plug constructed according to the present invention, generally indicated by the reference numeral 100, in which elements the same as, or similar to, those of spark plug 10 of FIG. 1 are given the same reference numerals plus 100. It may be assumed that spark plug 100 is manufactured generally in the same manner as spark plug 10. The major difference between spark plug 100 and spark plug 10 is that, during the manufacture of spark plug 100, a small quantity of particulate mixture is placed on head 126 of center electrode 124, then a ceramic cylinder 142 (also illustrated on FIG. 4) is placed on the initial quantity of particulate mixture, and then the balance of the particulate mixture is added. The rest of the manufacturing process is the same as for spark plug 10. The result of the addition of cylinder 142 is that resistor element 140 is considerably narrower in diameter than resistor element 14, although the ends 146 and 148 of the resistor element are the full diameter of upper portion 120 to permit sufficient physical and electrical connection of the resistor element to terminal post 130 and center electrode 128, respectively. It should be noted, also, that resistor element 140 is longer than resistor element 40, that spark plug 10O is somewhat longer than spark plug 10 by virtue of a greater length of shell 112 provided above the main portion of resistor element 140, and that there is an annular clearance space 144 between shell 112 and insulator 116 substantially along the full length of resistor element 14O. It will be noted that conventional spark plug 10 has virtually no such clearance space.

Figure 2:
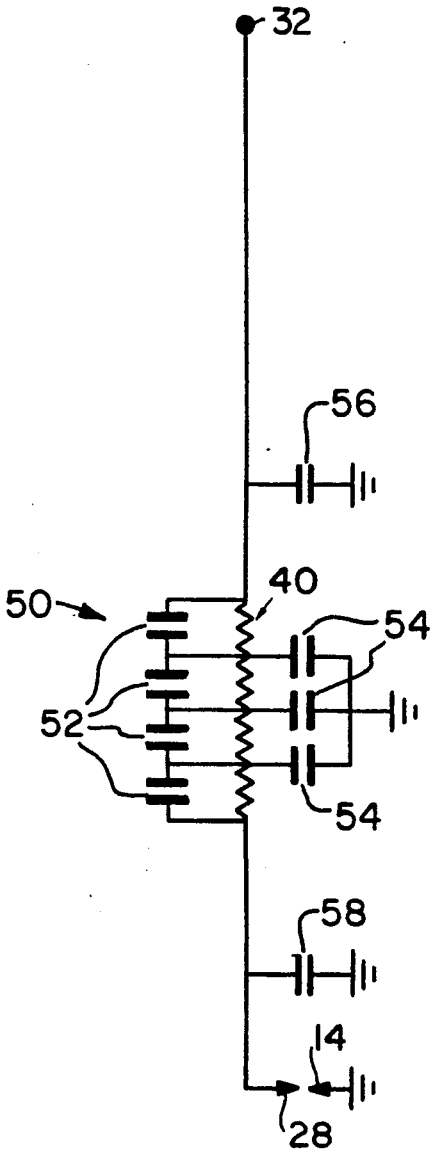
FIG. 2 PRIOR ART
FIG. 2 is a schematic diagram illustrating the relative capacitances between various elements of the spark plug of FIG. 1.
Figure 5:
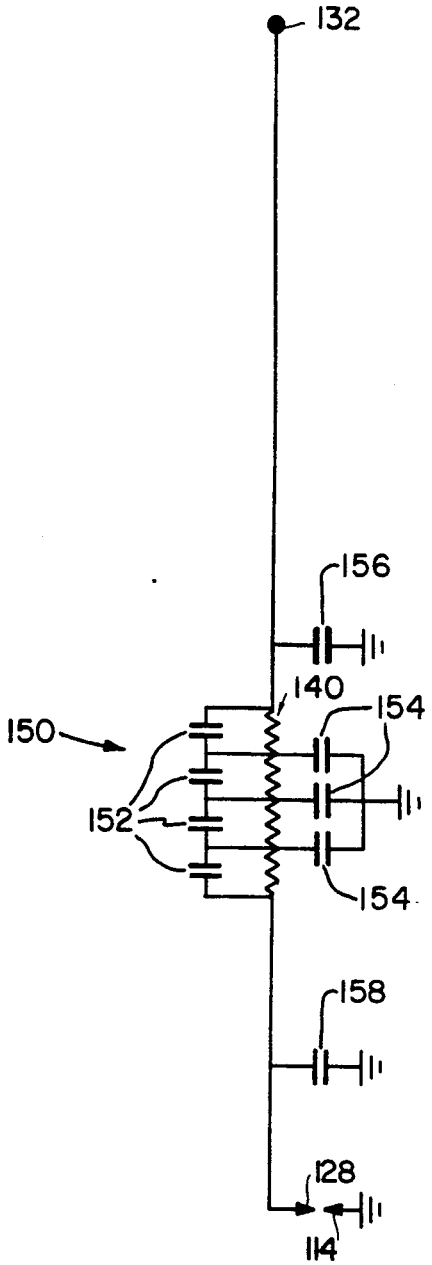
FIG. 5 a schematic diagram illustrating the relative capacitances between various elements of the spark plug of FIG. 3.

The approach taken by the present invention is to decrease the RFI while maintaining the resistive losses at conventional levels. Approximately a 26 db reduction in RFI without increasing spark plug fouling can be attained while at the same time the electrode erosion rate can be decreased. The means by which this is achieved can be understood by reference also now to FIGS. 2 and 5 which are equivalent circuits, generally indicated by the reference numerals 50 and 150, of spark plugs 10 and 100, respectively. Studying the circuits of FIGS. 2 and 5, it will be noted that the equivalent circuit of resistor elements 40 and 140 are essentially the same, but with different capacitive component values. The differences in such values is indicated by the thicknesses of the lines used to illustrate the capacitances, with thicker lines indicating higher capacitance values.

The effect of the much smaller diameter of resistance element 140 compared with resistance element 40 can be seen in the decrease in capacitance values between portions of the resistance elements, illustrated by capacitors 52 having much higher values than capacitors 152. Likewise, the effect of the smaller diameter of resistor element 140 and the presence of clearance space 144 is illustrated by capacitors 154 having lower capacitance values than capacitors 54. The high values of capacitors 52 and 54 tend to negate the RFI reducing effect of resistor element 40 while the low values of capacitors 152 and 154 make resistor element 140 more operative by affording is a higher frequency response. The greater length of shell 112 above the main portion of resistor element 140 causes capacitor 156, representing the capacitance between the shell and terminal post 130, to have a higher value than capacitor 56, thus providing more attenuation of noise generated in the spark gap between electrodes 114 and 128. The values of capacitors 58 and 158 representing the capacitances at the spark gaps of spark plugs 10 and 100, respectively, are essentially the same.

Curves 1 and 2 illustrate, respectively, the frequency of electromagnetic radiation from spark plugs 10 and 100 and show approximately 26 db attenuation of radio frequency radiation with spark plug 100 compared to spark plug 10.

The capacitance looking into the spark electrode in the spark plug of FIG. 1 is approximately 10 pf and in the spark plug of FIG. 3 is approximately 3.5 pf. The energy dissipated during the breakdown is $\frac{1}{2}CE^2=\frac{1}{2}(10^{-11})(10^8)=\frac{1}{2}$ mj in the first case and 1/6 mj in the second case. Hence, the electrode erosion rate due to the breakdown process is reduced by a factor of approximately three.

With resistor element 140 being made more effective by the present invention, the need for resistor wiring is reduced (and possibly eliminated); therefore, less energy need be provided for the ignition system. With a lowering of total ignition system resistance the tendency for spark plug fouling is reduced.

While the diameter of resistor element 140 is shown as being approximately one-third that of resistor element 40, or approximately one third of the diameter of upper portion 20 of the bore of insulator 116, and such has been found to be entirely satisfactory, it is preferable that the length-to-diameter ratio of the resistor element be as great as possible, within practical limits, to reduce end-to-end capacitance. It is also preferable that the extended portion of shell 112 be as long as possible and that the diameter of terminal post 130 be as large as possible, both within practical limitations, so that the value of capacitor 156 in equivalent circuit 150 of FIG. 5 will be a large as possible. Likewise, and again within practical limitations, it is desirable that clearance space 144 be as large radially as possible and extend over as great a length as possible of resistor element 140.

Ceramic cylinder 142 may be constructed by conventional methods from any suitable material which may be the same material as insulator 116. The other materials of spark plug 100 and the manner of its manufacture are conventional and may be as described in the above-referenced U.S. Pat. No. 4,795,944.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. An improved spark plug of the type having a shell, an insulator secured to and disposed within said shell, a bore defined axially through said insulator, said bore having an upper portion and a lower portion, a center electrode disposed in said lower portion, a terminal post disposed in said upper portion, and a fused particulate resistor element disposed between said terminal post and said center electrode; wherein the improvement comprises providing a clearance space between said shell and said resistor element along a sufficient length of said resistor element to reduce the capacitance between said resistor element and said shell, providing a portion of said shell extending above said resistor element a sufficient distance to increase the capacitance between said terminal post and said shell, and increasing the distance radially between at least a portion of said resistor element and said shell by narrowing the resistor element along at least a portion of the length thereof to thereby also further reduce the capacitance between said resistor element and said shell.

2. An improved spark plug, as defined in claim 1, wherein said clearance space is defined between said insulator and said shell.

3. An improved spark plug of the type having a shell, an insulator secured to and disposed within said shell, a bore defined axially through said insulator, said bore having an upper portion and a lower portion, a center electrode disposed in said lower portion, a terminal post disposed in said upper portion, and a fused particulate resistor element disposed between said terminal post and said center electrode; wherein the improvement comprises providing said resistor element having, along a sufficient length thereof, a diameter less than that of said upper portion of said bore to reduce the capacitance between said resistor element and said shell.

4. An improved spark plug, as defined in claim 3, further comprising a cylindrical element disposed around said sufficient length between said resistor element and the surface of said bore.

5. An improved spark plug, as defined in claim 3, wherein the diameter of said resistor element along said sufficient length is in the order of about one-third the diameter of said upper portion of said bore.

6. An improved spark plug of the type having a shell, an insulator secured to and disposed within said shell, a bore defined axially within said insulator, said bore having an upper portion and a lower portion, a center electrode disposed in said lower portion, a terminal post disposed in said upper portion, and a fused particulate resistor element disposed between said terminal post and said center electrode; wherein the improvement comprises providing said resistor element having, along a sufficient length thereof, a diameter less than that of said terminal post to reduce the capacitance between said resistor element and said shell.

7. An improved spark plug, as defined in claim 6, wherein the diameter of said resistor element along said sufficient length is in the order of about one-third the diameter of said terminal post.

* * * * *